US008735752B2

(12) United States Patent
Ahlert et al.

(10) Patent No.: US 8,735,752 B2
(45) Date of Patent: May 27, 2014

(54) MULTIPOLE ELECTRICAL SWITCHING DEVICE

(75) Inventors: Torsten Ahlert, Fürstenwalde (DE); Joerg-Uwe Dahl, Werder (DE); Ludvik Godesa, Berlin (DE); Marc Liebetruth, Glienicke (DE); Milos Petracek, Letohrad (CZ)

(73) Assignee: Siemens Aktiengesellschaft, Munich (DE)

( * ) Notice: Subject to any disclaimer, the term of this patent is extended or adjusted under 35 U.S.C. 154(b) by 185 days.

(21) Appl. No.: 13/245,070

(22) Filed: Sep. 26, 2011

(65) Prior Publication Data

US 2012/0073945 A1 Mar. 29, 2012

(30) Foreign Application Priority Data

Sep. 27, 2010 (DE) ..... 10 2010 041 467

(51) Int. Cl.
*H01H 13/04* (2006.01)

(52) U.S. Cl.
USPC ..... 200/293; 200/303; 355/202

(58) Field of Classification Search
None
See application file for complete search history.

(56) References Cited

U.S. PATENT DOCUMENTS

| | | | | |
|---|---|---|---|---|
| 4,218,596 | A | 8/1980 | Clausing | |
| 6,249,760 | B1 * | 6/2001 | Bossemeyer, Jr. | 704/225 |
| 6,429,760 | B1 | 8/2002 | Greenberg et al. | |
| 6,480,082 | B1 * | 11/2002 | Aihara et al. | 335/202 |
| 7,116,194 | B2 * | 10/2006 | Azzola et al. | 335/202 |
| 7,586,052 | B2 * | 9/2009 | Adunka et al. | 200/293 |
| 8,049,126 | B2 * | 11/2011 | Chen et al. | 200/400 |
| 2008/0237001 | A1 | 10/2008 | Gottschalk et al. | |
| 2009/0002106 | A1 | 1/2009 | Harmon et al. | |

FOREIGN PATENT DOCUMENTS

| | | | |
|---|---|---|---|
| DE | 10151422 | A1 | 5/2002 |
| DE | 60211028 | T2 | 10/2006 |
| EP | 0626712 | A1 | 11/1994 |
| EP | 1130683 | A1 | 9/2001 |
| EP | 1 464 063 | | 4/2006 |
| EP | 2009666 | A2 | 12/2006 |
| EP | 2180495 | A1 | 4/2010 |
| FR | 2550907 | A1 | 2/1985 |

OTHER PUBLICATIONS

German Priority Application No. DE 10 2010 041 467.0 filed Sep. 27, 2010 (Not Yet Published).
German language Search Report for German Patent Application No. DE 10 2010 041 467.0. dated Feb. 9, 2011.

* cited by examiner

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

A multipole electrical switching device is disclosed with an outer housing in which at least two separate switching pole housings are accommodated. In at least one embodiment, the at least two separate switching pole housings on walls facing towards one another, each have a least one mounting which form a mounting pair assigned to one another. In at least one embodiment, for mechanical connection of the at least two separate switching pole housings, the mounting pair is assigned at least one connection device which engages into the two mountings forming the mounting pair. The two mountings forming the mounting pair, in relation to a dividing joint formed between the two facing walls, each form an undercut, whereby the at least one connecting device engages behind the undercuts and the at least one connecting device is formed in a primary process in one piece on the outer housing.

4 Claims, 4 Drawing Sheets

MULTIPOLE ELECTRICAL SWITCHING DEVICE

PRIORITY STATEMENT

The present application hereby claims priority under 35 U.S.C. §119 on German patent application number DE 10 2010 041 467.0 filed Sep. 27, 2010, the entire contents of which are hereby incorporated herein by reference.

FIELD

At least one embodiment of the invention generally relates to a mechanical design of a multipole electrical switching device.

BACKGROUND

Electrical switching devices, for example low-voltage circuit-breakers in the form of so-called compact switches—known as MCCBs (Molded Case Circuit Breaker)—or in the form of so called open circuit breakers—known as ACBs (Air Circuit Breaker) are used to interrupt single-phase or multiple-phase current paths of a main circuit. The current paths are interrupted in such cases by mechanical opening of single-break or double-break switching contacts. In such cases the switching contacts must be arranged electrically insulated.

This insulation must be provided both from the installation environment and also—for multi-phase electrical switching devices—between the individual phases of the main circuit. In order to achieve this the parts of the electrical switching device which are assigned to such a phase of the main circuit and form a switching pole are each mounted in a separate switching compartment which is delimited by an insulating surround. These insulating surrounds—especially consisting of plastics—which also include a full range of rigid housing arrangements differing in their external appearance, at the same time prevent the unimpeded propagation of gas and particle releases arising during switching processes.

Thus these insulated surrounds typically essentially reside in a known housing arrangement in a lower housing part divided into chambers according to the number of switching poles and a suitable upper housing part, which are generally joined to each other by screw connections.

With the use of rotary double contacts (contact bridges) another housing concept, known as "cassette construction" has become established, in which a switchable, double-breakable contact bridge, together with two arc extinction chambers and possibly other components needed for each switching pole (slot motor, etc.) are arranged in an almost closed switching pole housing generally consisting of at least two half shells (individual pole cassettes). These prefabricated individual pole cassettes must now be combined into switching devices with the required number of poles in each case. In such cases the modularity and thus for example also the exchangeability of individual of the switching poles is to be retained.

In addition this combination of the switching pole housing (individual pole cassettes) is to be undertaken while guaranteeing maximum stability, since strong forces occur there between the individual switching poles of electrical switching devices during switching actions (especially when switching off in the power limit range of the switching devices) as a result of the magnetic field surrounding the individual phases of the current path, the necessity arises to restrict as far as possible a relative movement of the individual pole cassettes in relation to one another as a result of the forces acting on them.

A multipole electrical switching device in the form of a low-voltage circuit breaker is known from the German translation DE 602 11 028 T2 of the European patent EP 1 464 063 B1 for example, in which, in an outer housing referred to as a cover, a number of separate switching pole housings are accommodated between the sidewalls of the outer housing. In this known multipole electrical switching device each of the switching pole housings forms an insulating surrounding of the switching space for accommodating an individual switching pole of the electrical switching device. To provide a secure connection of the switching pole housing in respect of the forces acting during switching and in this case to avoid complicated joining operations, the switching pole housings, which are each formed from two half shells, have insulating channels which, in relation to dividing joints separating the half shells, extend transversely through the switching pole housing. The separate switching pole housings of the switching poles are connected in this case by spanning and transverse connection elements which extend right through the insulating channels.

Starting from a multipole electrical switching device with an outer housing, in which at least two separate switching pole housings are accommodated, which each form an insulated enclosure of a switching compartment to accommodate an individual switching pole, in which the at least two separate switching pole housings on the walls facing towards each other each feature at least one mounting which form a mounting pair, whereby for mechanical connection of the at least two separate switching pole housings the mounting pair is assigned a connection means that engages into the two mountings forming the mounting pair (German translation DE 602 11 028 T2 of the European patent EP 1 464 063 B1), the underlying object of the invention is also to create a secure connection of the switching pole housings in respect of the forces acting on them during switching and in doing so to avoid complicated joining operations.

SUMMARY

In at least one embodiment, the two mountings forming the mounting pair forming an undercut in each case in relation to a dividing joint formed between the two walls facing towards each other, whereby the at least one connection device engages behind the undercuts, and that on the other hand the at least one connection device is molded in a primary shaping process in one piece on the outer housing.

In at least one embodiment of the inventive multipole electrical switch, the adjacent switching pole housings are thus connected rigidly to each other after assembly by the connection device transverse to the dividing join engaging behind the undercuts of the mountings.

In this case the separate switching pole housings are assembly in an advantageously easy-to-handle manner in installation terms, in which savings are simultaneously made in components. On the one hand the joining operations are simplified by the fact that the assembly is undertaken starting from a front side of the electrical switching device in parallel to the walls of the switching pole housing facing towards each other in a preferred direction of assembly. On the other hand the connection devices are integrated by incorporating a corresponding contour in a tool used for manufacturing the outer housing with the manufacturing of the outer housing directly into this outer housing. Thus in particular the necessity of providing separate connection devices sets with connection devices of different lengths for different numbers of switching pole housings to be joined is dispensed with here, as is the case with the switch known from DE 602 11 028 T2, the entire contents of which are hereby incorporated herein by reference.

In an example embodiment there is provision with the inventive electrical switching device for the outer housing to form at least one stop running transversely to the dividing joint—preferably however also another second stop running transversely to the dividing joint—for the mounting pair. In such an embodiment, the mounting pair and thus the switching pole housings which form the mounting pair are namely fixed rigidly after assembly of the switching device in the preferred assembly direction between the two stops in the outer housing.

BRIEF DESCRIPTION OF THE DRAWINGS

Further advantages, features and properties of the present invention are explained below in more detail with the aid of example embodiments and with reference to the accompanying drawings, in which.

DETAILED DESCRIPTION OF THE EXAMPLE EMBODIMENTS

Figure 1:
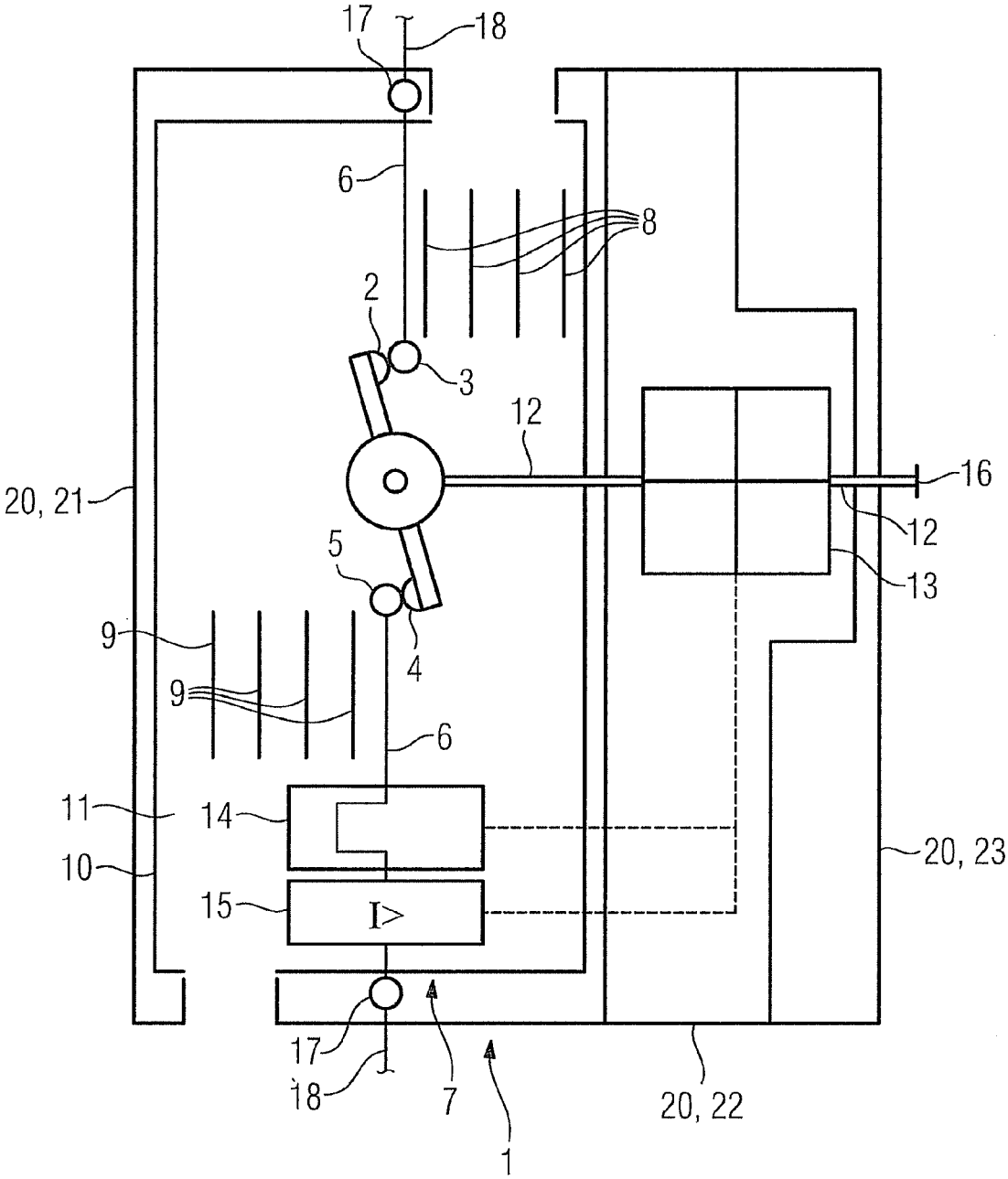
FIG. 1 shows a schematic diagram of an embodiment of the inventive electrical switching device in cross section through one of its separate switching pole housings arranged in an outer housing.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In accordance with the basic scheme of an embodiment of the inventive multipole electrical switching device 1 shown in FIG. 1, this switching device has switching contacts 2, 3 and 4, 5 for double interruption of a first current path 6 of a first switching pole 7. The current path is part of a first main current path of an energy distribution network, especially a low-voltage network. The switching contacts 2, 3 are assigned a first arc extinction element and the switching contacts 4, 5 a second arc extinction element, whereby the arc extinction elements are embodied as extinction units 8, 9.

The electrical switching device 1 has a first switching space 11 delimited by a first switching pole housing 10 to accommodate the switching contacts 2, 3; 4, 5 of the first switching pole 7. Drive elements which form a drive mechanism 12 of the electrical switching device, serve to open and close the switching contacts 2, 3; 4, 5. The electrical switching device also has a switch-off mechanism 13 in the form of a switch lock. The switch lock is arranged as a mechanical intermediate element between the switching and drive elements as part of the drive mechanism 12.

Trigger elements are provided in the electrical switching device 1, which trigger the switch-off mechanism 13—i.e. release a latch of the switching lock, in order to set in train the drive mechanism 12 for opening the switching contacts. In particular a thermal trigger 14 (as overload detection element), an electromagnetic trigger 15 (as short-circuit detection element) and a manual trigger 16 projecting from the insulating cover on the front of the unit are provided as trigger elements by means of which the switching lock can be triggered for opening the switching contacts 2, 3; 4, 5. However a pressure trigger (as the short-circuit detection element) or an electronic trigger (as an overload and/or short-circuit detection element) can also be provided.

The electrical switching device 1 has further switching compartments in parallel to the first switching compartment 11 shown in FIG. 1. The further switching compartments are each delimited by further separate switching pole housings. Arranged in the further switching compartments are switching contacts of further switching poles. The ends of the current path 6 of each of the switching poles 7 are electrically connected by means of line terminals 17 to at least one electrical line 18 of the respective main current path of the energy distribution network. The separate switching pole housings 10 are arranged between a first part 21 embodied as a floor and a second part 22 embodied as an intermediate roof of an outer housing 20. A third part 23 of the outer housing forming an insulating cover usually serves to cover accessories not shown in any greater detail here, which are arranged in pockets of the intermediate cover.

Figure 2:
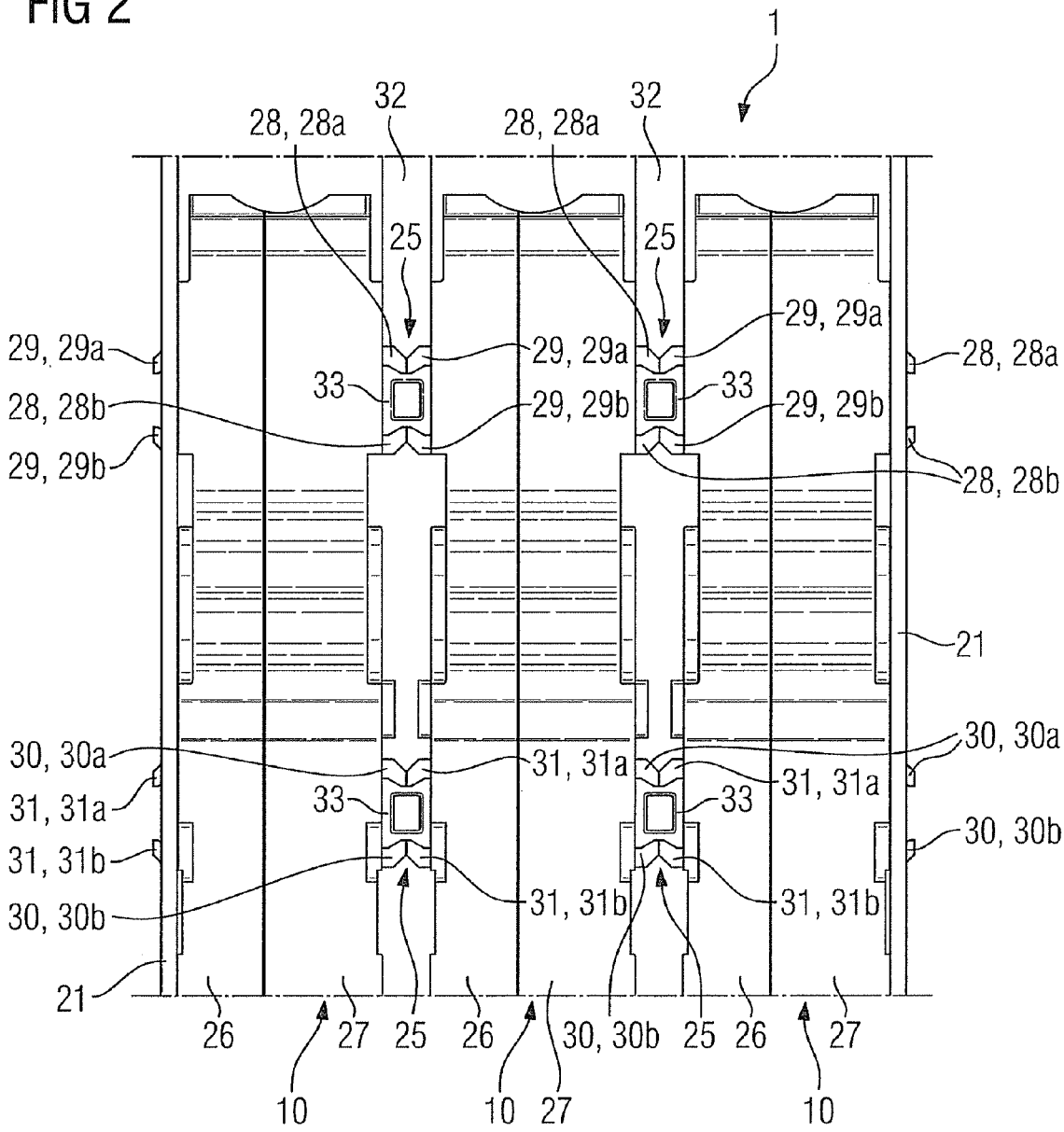
FIG. 2 shows a first part of the outer housing with the separate switching pole housing arranged therein, looking towards the connection devices which connect adjacent switching pole housings in each case.

In accordance with FIG. 2 an embodiment of the inventive multipole electrical switching device 1 is embodied in the form of a three-pole, low-voltage circuit breaker in the form of a compact circuit breaker as a "cassette". It thus has three separate switching pole housings 10, which are connected to each other via connection means identified overall by the number 25. Each of the three switching pole housings 10 consists of two half shells 26, 27 and forms an insulating outer housing of one of the switching compartments 11 (cf. FIG. 1), in which one of the three switching holes is arranged in each case.

Two adjacent switching pole housings of the three separate switching pole housings 10 are mechanically connected in this case by means of two of the connection devices 25 respectively. To this end the separate switching pole housings 10 have hook-like lateral projections 28*a*, 28*b*, 29*a*, 29*b*, 30*a*, 30*b*, 31*a* 31*b* on their walls facing towards one another. Two of the hook-like projections 28*a*, 28*b*; 29*a*, 29*b*; 30*a*, 30*b* and 31*a*, 31*b* in each case form a mounting 28; 29; 30; 31, which in relation to a dividing joint 32, which is formed between the two walls facing towards one another, form an undercut in each case. The adjacent mountings 28 and 29 or 30 and 31 of switching pole 10 lie opposite one another as a mounting pair. For mechanical connection of the separate switching pole housings 10 each mounting pair is assigned a respective connection means 33 molded as a contour element in a primary shaping method in one piece onto the floor of the outer housing. The connection means 33 engages behind the undercuts of the mountings 28 and 29 or 30 and 31 of the assigned mounting pair respectively.

The connection devices 33 have a cross section in such cases which is formed as a type of double swan neck. They extend like a type of pin into the area of the dividing joint 32 in parallel to the dividing joint 32. Accordingly each of the mountings forms a corresponding slot extending in parallel to the dividing joints 32 with a swan neck shaped cross-sectional form.

Figure 3:
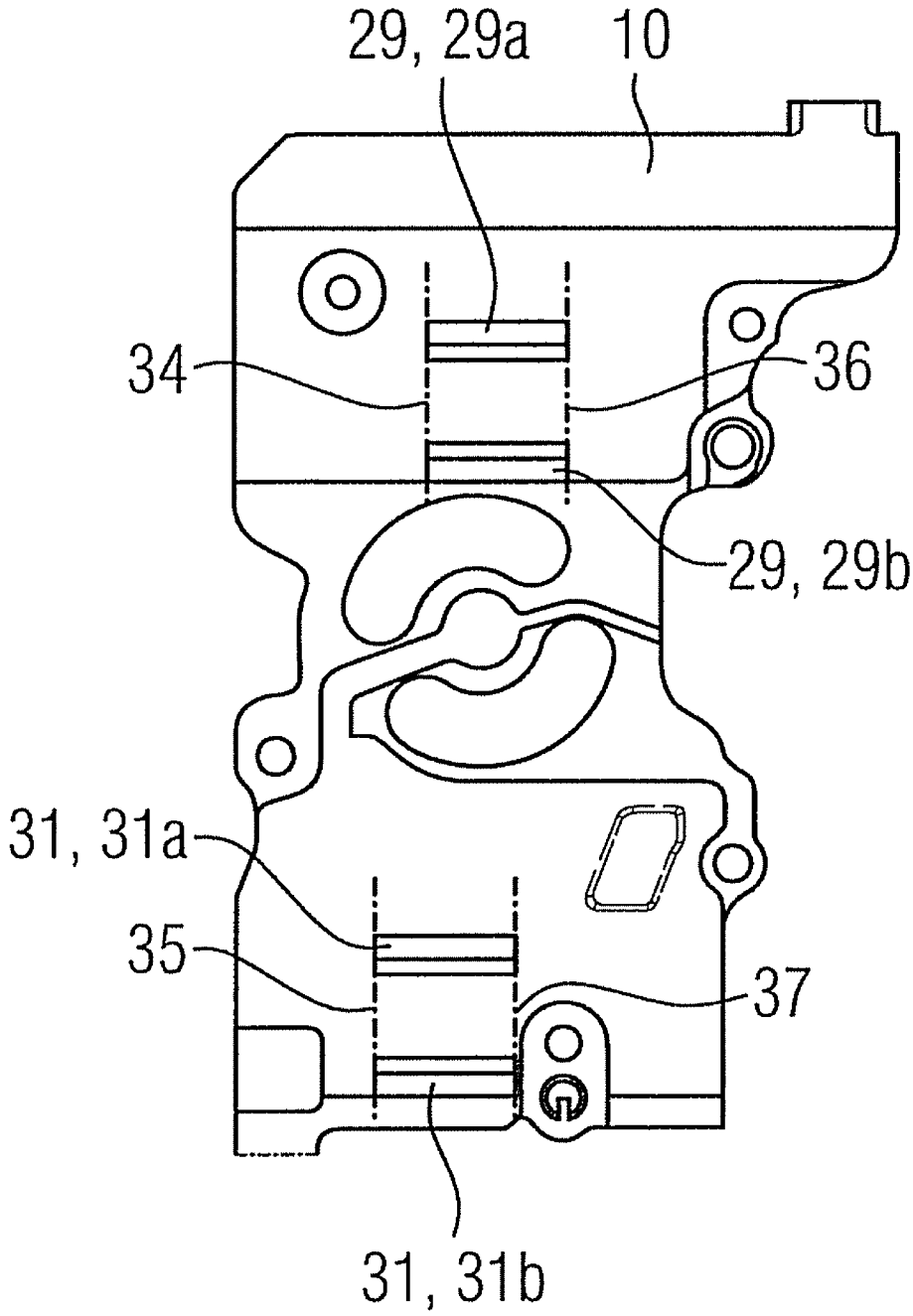
FIG. 3 shows a side view of one of the separate switching pole housings and FIGS. 4 and 5 shows a section of the first part of the outer housing shown in FIG. 2 in a perspective view and after the insertion of one of the separate switching pole housings.
Figure 4:
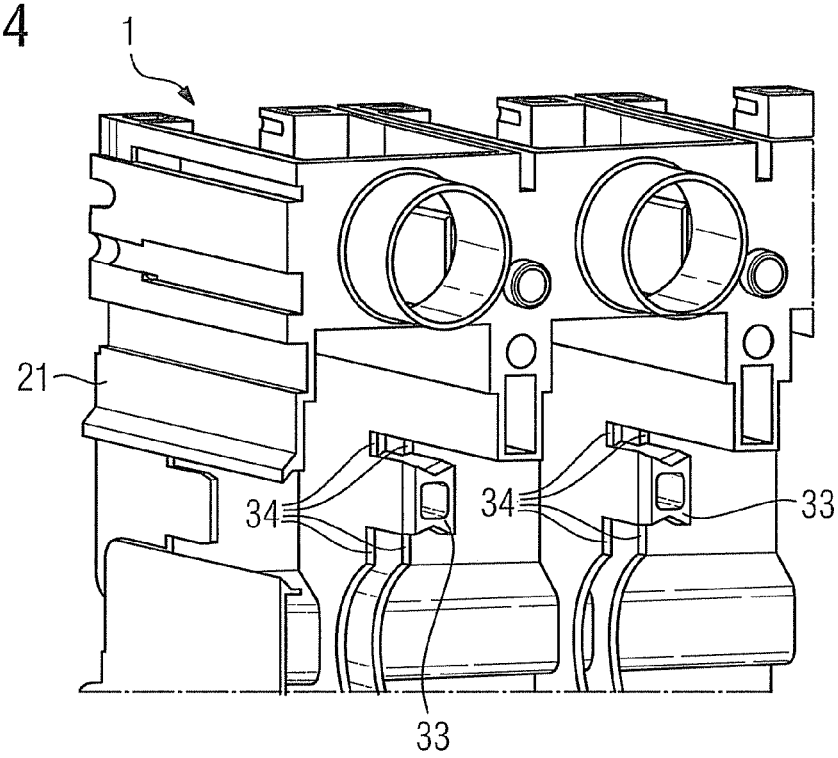
Figure 5:
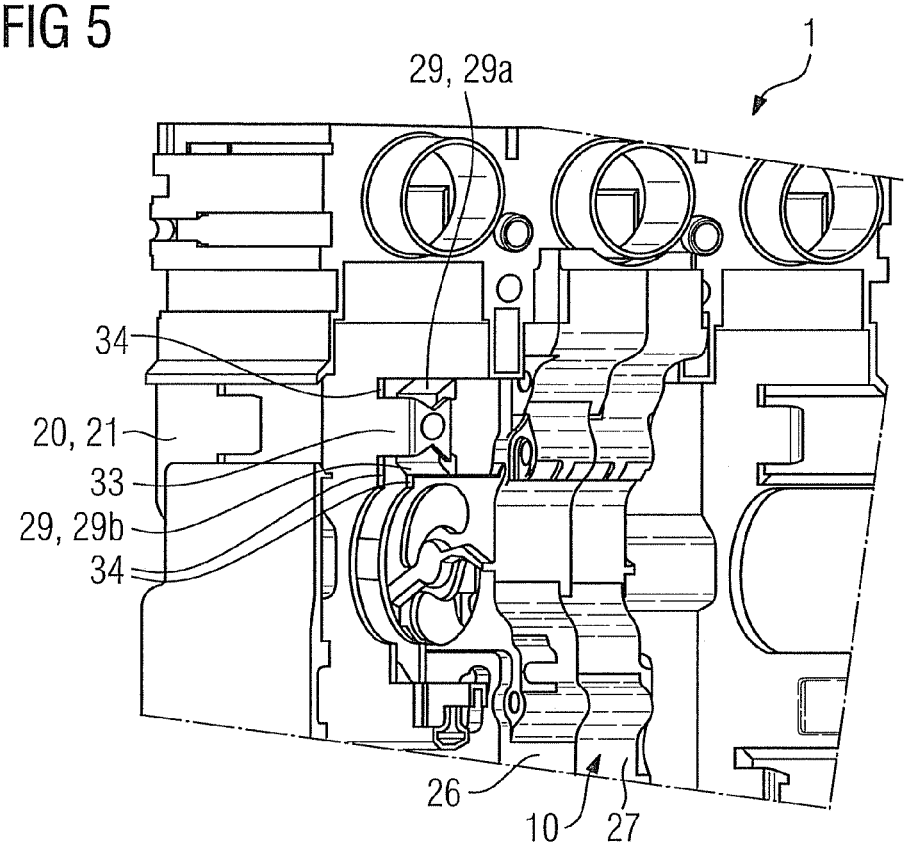

In order to ensure that the switching pole housings 10, after the installation of the switching device in the preferred direction of installation, are rigidly fixed in the outer housing, the first part 21 of the outer housing embodied as a floor forms for each of the mounting pair respectively a first stop 34; 35 running transverse to the dividing joints 32 (cf. FIGS. 3 to 5) and the second part 22 of the outer housing embodied as an intermediate cover 22 forms for each of the mounting pairs in each case a second stop 36; 37 running transversely to the dividing joints 32 (cf. FIG. 2). The stops are designed so that the mountings (28, 29; 30, 31) of the mounting pairs are held with their end face sides running transverse dividing joints after assembly between the first (34; 35) and second (36; 37) stops assigned to them in a fixed position in relation to the outer housing.

In an embodiment of the inventive electrical switching device the connection devices 25 do not include separate individual parts but are integrated into the components of the electrical switching device present in any event. An embodiment of the inventive multipole electrical switching device is able to be installed in a preferred installation direction. A transverse connection through the switching compartments is not required and the associated insulation problems do not occur.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multipole electrical switching device, comprising:

an outer housing;

at least two separate switching pole housings, accommodated in the outer housing, each of the at least two separate switching pole housings forming an insulating outer housing of a switching compartment for accommodating an individual switching pole, the at least two separate switching pole housings, on walls facing towards each other, each wall including at least one mounting extending therefrom which forms a mounting pair assigned to each other, whereby, for mechanical connection of the at least two separate switching pole housings, the mounting pair is assigned at least one connection device between the at least two separate switching pole housings which engages into the two mountings forming the mounting pair, the two mountings forming the mounting pair form an undercut in relation to a dividing joint formed between the two walls facing towards each other in each case, whereby the at least one connection device engages below the undercuts, and the at least one connection device is molded in a primary shaping process in one piece extending from the outer housing.

2. A multipole electrical switching device as claimed in claim 1, wherein the outer housing forms at least one first stop running transversely to the dividing joint for the mounting pair.

3. A multipole electrical switching device as claimed in claim 2, wherein the outer housing, in addition to the first stop, forms a second stop running transversely to the dividing joint for the mounting pair such that, after the installation of the switching device housing in the outer housing, the mounting pair is held in a fixed position in relation to the outer housing between the first and the second stop.

4. A multipole electrical switching device as claimed in claim 1, wherein the mounting pair is slidingly engagable along an axial length of the connecting device.

* * * * *